US006336343B1

(12) United States Patent
Nishioka et al.

(10) Patent No.: US 6,336,343 B1
(45) Date of Patent: Jan. 8, 2002

(54) TWO-STAGE ABSORPTION REFRIGERATING APPARATUS

(75) Inventors: Akira Nishioka, Tsuchiura; Tomihisa Ohuchi, Tsukuba; Tatsuo Fujii; Satoshi Miyake, both of Chiyoda; Atsushi Shitara, Tokyo; Toshikuni Ohashi, Osaka; Mitsuharu Matsubara, Tokai, all of (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 09/811,505

(22) Filed: Mar. 20, 2001

(30) Foreign Application Priority Data

Sep. 8, 2000 (JP) ..... 12-278652

(51) Int. Cl.[7] ..... F25B 43/04

(52) U.S. Cl. ..... 62/475; 62/85; 62/195; 62/476

(58) Field of Search ..... 62/85, 195, 470, 62/475, 476, 483, 495, 509

(56) References Cited

U.S. PATENT DOCUMENTS 3,360,950 A * 1/1968 Osborne ..... 62/85
4,304,102 A * 12/1981 Gray ..... 62/195
5,313,805 A * 5/1994 Blackmon et al. ..... 62/195
5,598,714 A * 2/1997 Strout et al. ..... 62/85

* cited by examiner

*Primary Examiner*—Henry Bennett
*Assistant Examiner*—Melvin Jones
(74) *Attorney, Agent, or Firm*—Antonelli, Terry, Stout & Kraus, LLP

(57) ABSTRACT

A two-stage absorption refrigerating apparatus includes an integrated drum in which a low-pressure evaporator and a low-pressure absorber are arranged in an upper part and a high-pressure evaporator and a high-pressure absorber are arranged in a lower part. Uncondensed gas resulted in a high-temperature generator and elsewhere successively moves toward a low-pressure side along with a circulation of refrigerant and solution. The uncondensed gas deposited in the high-pressure absorber is extracted by bleeding device, and the uncondensed gas deposited in the low-pressure absorber is extracted by an ejector. The extracted uncondensed gas is stored into a gas storage tank via a gas-liquid separator. A valve is provided on the gas storage tank.

17 Claims, 9 Drawing Sheets

TWO-STAGE ABSORPTION REFRIGERATING APPARATUS

BACKGROUND OF THE INVENTION

The present invention relates to an absorption refrigerating apparatus having two stage evaporators and two stage absorbers, and more particularly to a two-stage absorption refrigerating apparatus suitable for cases in which cold water flows through the two stage evaporators in series.

An example of two-stage absorption refrigerating apparatus having two evaporators and two absorbers wherein cooling water, after cooling a solution in one of the absorbers, cools a solution in the other absorber is disclosed in JP-A-10-300257 specification. Also, examples of two-stage absorption refrigerating apparatus in which a refrigerant sprayed in one of the evaporators is sprayed in the other evaporator and, similarly, a solution sprayed in one of the absorbers is sprayed in the other absorber are described in JP-A-10-160276, JP-A-10-160277 and JP-A-10-160278 specifications.

Among these prior arts, in the refrigerating apparatus disclosed in JP-A-10-300257 specification, in order to simplify a medium circulating circuit for thermally transferring cold generated by the evaporators to a cold-using unit such as an indoor heat exchanger of an air conditioner and thereby enhancing the refrigerating performance of the refrigerating apparatus, a non-azeotropic mixed refrigerant consisting of a plurality of kinds of refrigerants having different boiling points is used as heat-carrying medium circulating between the evaporators of the refrigerating apparatus and the cold-using units. The apparatus has a plurality of absorbers and evaporators to have the non-azeotropic mixed refrigerant evaporated or absorbed in multiple stages.

According to JP-A-10-160276, JP-A-10-160277 and JP-A-10-160278 specifications, in order to increase the utilization rate of exhaust heat in cogeneration systems and thereby reduce the consumption of highergrade fuel, a reducing valve and a heat exchanger for a heat source are provided between a low-temperature solution heat exchanger and a low-temperature generator of a weak solution line, so that the utilization rate of exhaust heat can be increased through exchanges between sensible heat and latent heat. The evaporators and absorbers are divided into a plurality of stages to reduce the concentration of the weak solution line to cause sensible heat and latent heat to be exchanged and thereby to reduce the return temperature of the exhaust heat line.

Incidentally, in an absorption refrigerating apparatus, various elements constituting the apparatus are operated in a vacuum ambiance. For this reason, if any air comes in from outside on account of any factors during operation, or if the absorption solution, water or the like slightly reacts with wall faces of a drum and many heat transfer pipes arranged within the apparatus to generate uncondensed gas, the degree of vacuum of the refrigerating cycle formed within the refrigerating apparatus will be deteriorated.

Since a deterioration in the degree of vacuum results a drop in refrigerating efficiency, it is necessary to discharge outside without delay the air and uncondensed gas, which do not contribute to evaporation or absorption. None of the above described patent applications contains any mention of bleeding the air or uncondensed gas from the refrigerant flow or the solution flow. In particular, where the absorbers are provided in two stages in order to take out cold of necessary temperature or to accomplish efficient exchange of sensible heat and latent heat, since the two stages of absorbers are partitioned from each other, sufficient bleeding of uncondensed gas is impossible if only one stage of absorber is provided with a bleeder.

BRIEF SUMMARY OF THE INVENTION

The present invention is made in view of the technical inadequacies of the above-described prior arts and an object of the invention is to enhance the absorbing capacity of an absorption refrigerating apparatus having a low-pressure absorber and a high-pressure absorber by extracting uncondensed gas. Another object of the invention is to make it possible in a simple configuration to discharge uncondensed gas collected in absorbers out of a two-stage absorption refrigerating apparatus. The invention can attain its purpose if either of these objects is attained.

In order to attain the objects, according to a first aspect of the present invention, there is provided a two-stage absorption refrigerating apparatus including: a high-temperature generator; a low-temperature generator; a condenser; a low-pressure absorber; a low-pressure evaporator; a high-pressure absorber; and a high-pressure evaporator, in which the low-pressure absorber is provided with first bleeding means for bleeding the uncondensed gas in the low-pressure absorber and the high-pressure absorber is provided with second bleeding means for bleeding the uncondensed gas in the high-pressure absorber.

In the two-stage absorption refrigerating apparatus according to the first aspect of the invention, the high-pressure absorber may be arranged underneath the low-pressure absorber and the high-pressure evaporator may be arranged underneath the low-pressure evaporator; the first bleeding means and the second bleeding means may be supplied with the absorption solution from a single pump; the uncondensed gas extracted by the first bleeding means may be led to the high-pressure absorber; confluent means for combining the uncondensed gas extracted by the first bleeding means with the uncondensed gas extracted by the second bleeding means may be provided; and the low-pressure absorber, the low-pressure evaporator, the high-pressure absorber and the high-pressure evaporator may be configured into an integrated drum.

Also in the two-stage absorption refrigerating apparatus according to the first aspect of the invention, the high-pressure absorber may be arranged underneath the low-pressure absorber and the high-pressure evaporator may be arranged underneath the low-pressure evaporator; the first bleeding means may be provided with first pumping means for supplying the absorption solution and the second bleeding means may be provided with second pumping means for supplying the absorption solution; and the uncondensed gas extracted by the first bleeding means may be led to the high-pressure absorber.

Further, the first bleeding means may be provided on a side or near the bottom of the low-pressure absorber and the second bleeding means may be provided at the bottom of the high-pressure absorber; at least one of the first bleeding means and the second bleeding means may be ejector or liquid jet type bleeding means; a communicating pipe for leading the gas in the high-pressure absorber to the low-pressure absorber may be provided on a side of the high-pressure absorber; and piping means for leading the uncondensed gas extracted by the first bleeding means to the vicinity of the second bleeding means may be provided.

In order to attain the objects, according to a second aspect of the present invention, there is provided a two-stage absorption refrigerating apparatus, in which the apparatus includes: a high-temperature generator; a low-temperature generator; a condenser; a low-pressure absorber; a low-pressure evaporator; a high-pressure absorber; and a high-pressure evaporator, and water is used as refrigerant and an aqueous solution of lithium bromide is used as absorption solution, in which the low-pressure absorber is provided with first bleeding means for extracting uncondensed gas within the low-pressure absorber; the high-pressure absorber is provided with second bleeding means for extracting uncondensed gas within the high-pressure absorber; the condenser is provided with third bleeding means for extracting uncondensed gas within the condenser, a pump for supplying the solution to these bleeding means, a gas-liquid separator for separating the uncondensed gas extracted by these bleeding means from the solution, and a gas storage tank for storing the uncondensed gas separated from the solution are provided; and the uncondensed gas extracted by the first bleeding means and the second bleeding means is fed together with the solution by the pump to the high-temperature generator and the low-temperature generator, and thereafter it is fed together with refrigerant vapor generated by the high-temperature generator and the low-temperature generator to the condenser, and the uncondensed gas is extracted by the third bleeding means in the condenser, and the bled uncondensed gas is fed together with the solution to the gas-liquid separator, and is separated from the solution by the gas-liquid separator, and is accommodated into the gas storage tank.

The gas storage tank is provided with pressure gauging means, and an ejector is connected through a valve, and the valve is opened when the pressure detected by the pressure gauging means surpasses a predetermined level, and the uncondensed gas within the gas storage tank is discharged outside by means of the ejector. It is preferable to arrange the gas storage tank in the uppermost part of this two-stage absorption refrigerating apparatus.

DETAILED DESCRIPTION OF THE INVENTION

Figure 1:
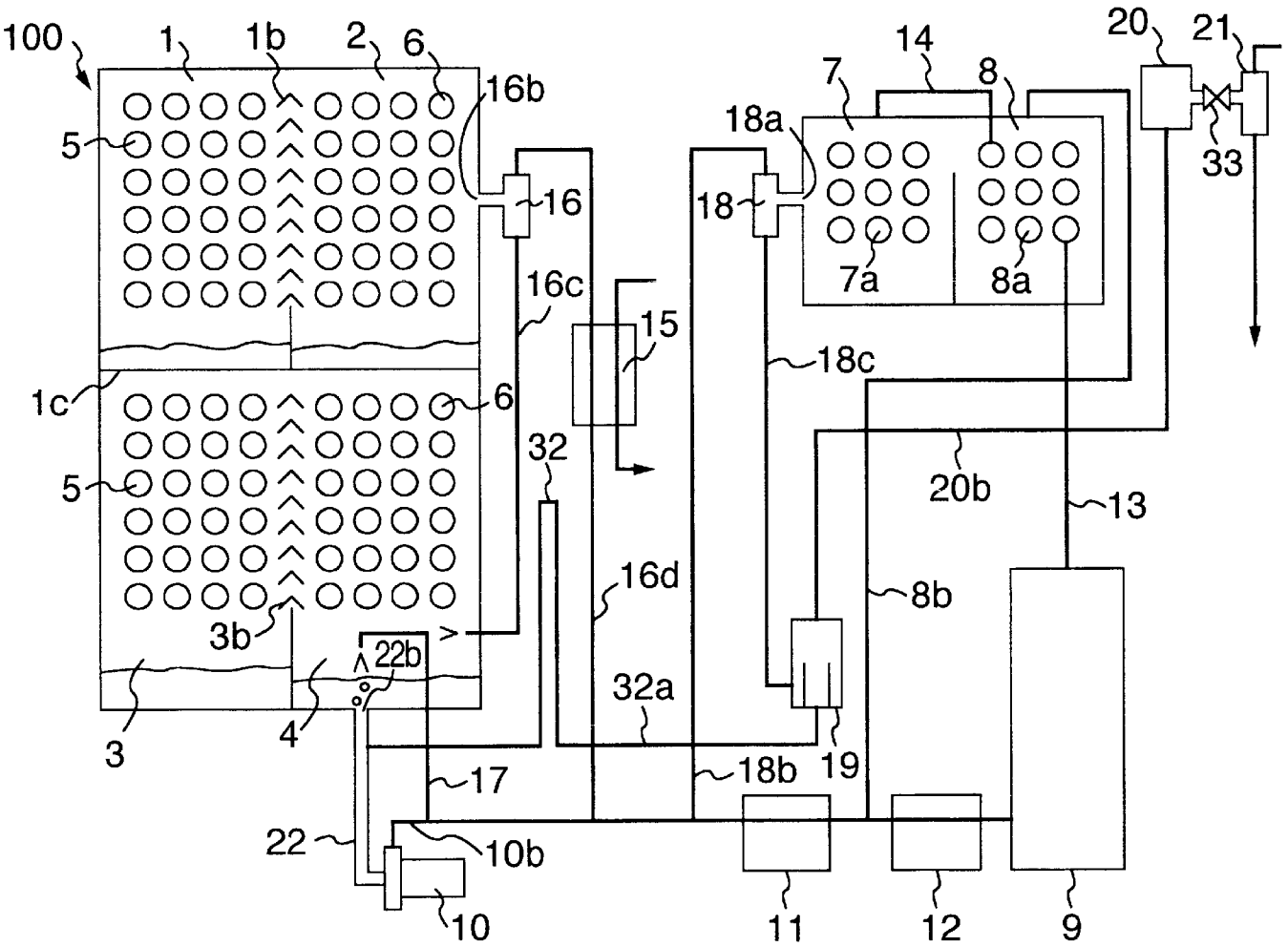
FIG. 1 is a schematic diagram of an embodiment of a two-stage absorption refrigerating apparatus according to the present invention.

Embodiments and their variations of the present invention will be described hereinafter with reference to the accompanying drawings. FIG. 1 shows a schematic structure of an embodiment of a two-stage absorption refrigerating apparatus of the present invention. A two-stage absorption refrigerating apparatus 100 comprises a high-temperature generator 9, a low-temperature generator 8, a condenser 7, a low-pressure evaporator 1, a low-pressure absorber 2, a high-pressure evaporator 3, and a high-pressure absorber 4. Refrigerant of the two-stage absorption refrigerating apparatus 100 here is water, and solution is an aqueous solution of lithium bromide.

The low-pressure evaporator 1 and the low-pressure absorber 2 constitute an integrated chamber with an eliminator 1*b* in-between, and their internal pressures are substantially equal. Underneath the low-pressure evaporator 1 is arranged the high-pressure evaporator 3 with a partition 1*c* in-between and, similarly, underneath the low-pressure absorber 2 is the high-pressure absorber 4 with the partition 1*c*in-between. The high-pressure evaporator 3 and the high-pressure absorber 4 adjoin each other with an eliminator 3*b* in-between, and their internal pressures are substantially equal.

Inside the low-pressure evaporator 1, there is arranged a heat transfer pipe 5 within which cold water runs, and the heat transfer pipe 5 also passes inside the high-pressure evaporator 3. Similarly, inside the low-pressure absorber 2, there is arranged a heat transfer pipe 6 within which cooling water runs, and the heat transfer pipe 6 also passes inside the high-pressure absorber 4. The low-pressure evaporator 1, the low-pressure absorber 2, the high-pressure evaporator 3 and the high-pressure absorber 4 are configured into an integrated drum.

Also, though not shown, refrigerant spraying devices are provided at upper portions of the low-pressure evaporator 1 and the high-pressure evaporator 3, and solution spraying devices are provided at upper portions of the low-pressure absorber 2 and the high-pressure absorber 4. Further, liquid refrigerant tank sections are formed underneath the low-pressure evaporator 1 and the high-pressure evaporator 3 to accommodate part of the refrigerant which was sprayed by the refrigerant spraying devices provided at the upper portions but has not been evaporated. Solution tank sections are formed at lower portions of the low-pressure absorber 2 and the high-pressure absorber 4 to accommodate part of the solution which was sprayed by the solution spraying devices provided at the upper portions and has been diluted by absorbing refrigerant vapor.

In a side part of the low-pressure absorber 2, there is formed a port 16*b* communicating with an ejector 16, and one end of the ejector 16 and a side part of the high-pressure absorber 4 are connected by a pipe 16*c*. The other end of the ejector 16 is connected to a solution pipe 10*b*. From the pipe 10*b*, a solution pressurized by a solution-circulating pump 10 is led to the ejector 16.

At the bottom of the high-pressure absorber 4, there is formed a port 22*b*, to which a suction pipe 22 is connected. The other end of the suction pipe 22 is connected to an intake side of the solution-circulating pump 10. A discharge side of the solution-circulating pump 10 is connected to the solution pipe 10*b*, from which branches off a jet generator 17 for supplying a solution jet into the high-pressure absorber 4.

Downstream from where the jet generator 17 branches off the pipe 10*b*, there is provided a branching part of a pipe 16*d* for supplying the solution to the aforementioned ejector 16. Midway on this pipe 16*d* is arranged an ejector cooler 15 for cooling the solution. In the ejector cooler 15, the solution is cooled with cooling water, cold water, refrigerant or the like.

Further downstream from the pipe 10*b* branch to the ejector 16, a pipe 18*b* for supplying the solution to an ejector 18 provided in the condenser to be described afterwards is provided. Still further downstream from this branch, there is arranged a low-temperature heat exchanger 11 for heat exchange between a strong solution condensed at the low-temperature generator 8 and the high-temperature generator 9 and a weak solution resulting from the absorption of the refrigerant at the low-pressure absorber 2 and the high-pressure absorber 4. Yet further downstream from the low-temperature hat exchanger 11 is formed a branching part of a solution pipe 8*b* for supplying the weak solution to the low-temperature generator 8, and still further downstream from this branching part, arranged is a high-temperature heat exchanger 12 for heat exchange between the strong solution generated at the high-temperature generator 9 and the weak solution.

Refrigerant vapor generated at the high-temperature generator 9 circulates through a heat transfer pipe 8*a* arranged within the low-temperature generator 8, and exchanges heat with the weak solution fed by the solution-circulating pump 10 to the low-temperature generator 8. Later on, the vapor flows into the condenser 7 via a pipe 14. Within the condenser 7, there is arranged a heat transfer pipe 7*a*. Cooling water flows through the heat transfer pipe 7*a* to cool the refrigerant vapor led from the pipe 14. The refrigerant liquid condensed by being cooled is fed to the high-pressure evaporator 3 through a pipe, not shown.

On the other hand, the strong solutions concentrated at the high-temperature generator 9 and the low-temperature generator 8 are respectively led through pipes, not shown, to the high-temperature heat exchanger 12 and the low-temperature heat exchanger 11 to exchange heat. The strong solution reduced in temperature by the heat exchange is fed to a spraying device, not shown, in the low-pressure absorber 2.

The condenser 7 is formed with a port 18*a* communicating to the ejector 18 on a side portion thereof. One end of the ejector 18 is connected to the pipe 18*b* for supplying the solution from the solution-circulating pump 10 to the ejector 18. The other end of the ejector 18 is connected to a gas-liquid separator 19. A bottom of the gas-liquid separator 19 is connected to a pipe 32*a* which joins the suction pipe 22 connected to the bottom of the high-pressure absorber 4. Midway on the pipe 32*a* is formed a rising part 32, whose top is even higher than the top of the gas-liquid separator 19.

A ceiling part of the gas-liquid separator 19 is connected by a pipe 20*b* to a gas storage tank 20, to which an ejector 21 is connected through a valve 33. The ejector 21 is driven with cooling water, cold water or tap water. Incidentally, the gas storage tank 20 is installed in the highest position in the absorption refrigerating apparatus.

Next, the actions of the present embodiment configured in this manner will be described. In order to generate cold water to be supplied to a demander, cold water is first passed through the heat transfer pipe 5 in the high-pressure evaporator 3 of which temperature is high to evaporate the water, which is the refrigerant, in a high-pressure ambiance. The cold water in the heat transfer pipe 5 is then led to the heat transfer pipe 5 in the low-pressure evaporator 1, and cooled by a low-pressure and low-temperature refrigerant. A thick absorption solution is supplied to inside the low-pressure absorber 2, and the concentration of the solution is reduced as the absorption solution absorbs the refrigerant vapor generated at the low-pressure evaporator 1. The absorption solution of which concentration has become thin is led to a spray device, not shown, in the high-pressure absorber 4 by transport means, not shown. As the low-concentration absorption solution still has an absorbing capacity in a high-pressure ambiance, by structuring two absorbers of which pressure ambiences are different from each other, it is possible to enable the absorption solution to effectively perform absorption.

While the diluted solution having deposited in the solution tank section at the bottom of the high-pressure absorber 4 is mostly led by the solution-circulating pump to the low-temperature generator 8 and the high-temperature generator 9, part of it is supplied in a jet form from the pipe 17 to the solution tank section of the high-pressure absorber 4. On an extension of this jet, the port 22*b* is formed. Together with bubbles formed when the jet hits the liquid surface, gas around them is forcibly sucked toward the solution-circulating pump 10 through the port 22*b*. If uncondensed gas, described later, is included in the surrounding gas, it is bled from the high-pressure absorber 4 by the action of the jet and fed to the high-temperature generator 9 by the solution-circulating pump 10.

As the solution and the refrigerant circulate, most of the uncondensed gas generated in different parts of the absorption refrigerating apparatus deposit in the low-pressure absorber 2 of which pressure is the lowest. Then, the uncondensed gas is extracted with the ejector 16 provided in the low-pressure absorber 2. The ejector 16 sucks the refrigerant vapor and the uncondensed gas together, and they are led to the high-pressure absorber 4 together with a solution, which is the driving fluid of the ejector 16. The uncondensed gas in the low-pressure absorber 2 is transferred in this manner to the high-pressure absorber 4.

Incidentally, it is preferable for the solution for driving the ejector 16 to be cooled in advance, because the suction capacity of the ejector 16 is restricted by a saturation pressure of the driving fluid. In this embodiment, the saturation pressure is reduced and the suction capacity is enhanced by cooling the solution with the cooling water which cools the absorption solution, the cold water having returned from the demander, the refrigerant in the evaporators or the like. The cooling temperature descends in the order of cooling water, cold water and refrigerant, and the lower temperature a cold source is used, the more the heat transfer area can be reduced. Therefore, the cost can be reduced correspondingly. However, since the cold water and the refrigerant are working fluids in the absorption refrigeration cycle, their use for the cooling purpose invites a drop in the efficiency of the absorption refrigeration cycle. Therefore, where emphasis is to be placed on efficiency, it is preferable to use the cooling water.

When the cooling water is to be used, the cooler 15 may be dispensed with, and a heat transfer pipe to pass the solution may be arranged in a header, not shown, for distributing the cooling water to the heat transfer pipe 6 in the high-pressure absorber 4, because the space for arranging the heat transfer pipe can be readily secured in a header. In a case where the cooler 15 is to be used as illustrated in FIG. 1, it is preferable to use a contraflow arrangement in which the cooling water and the solution flow in mutually opposite directions.

Figure 2:
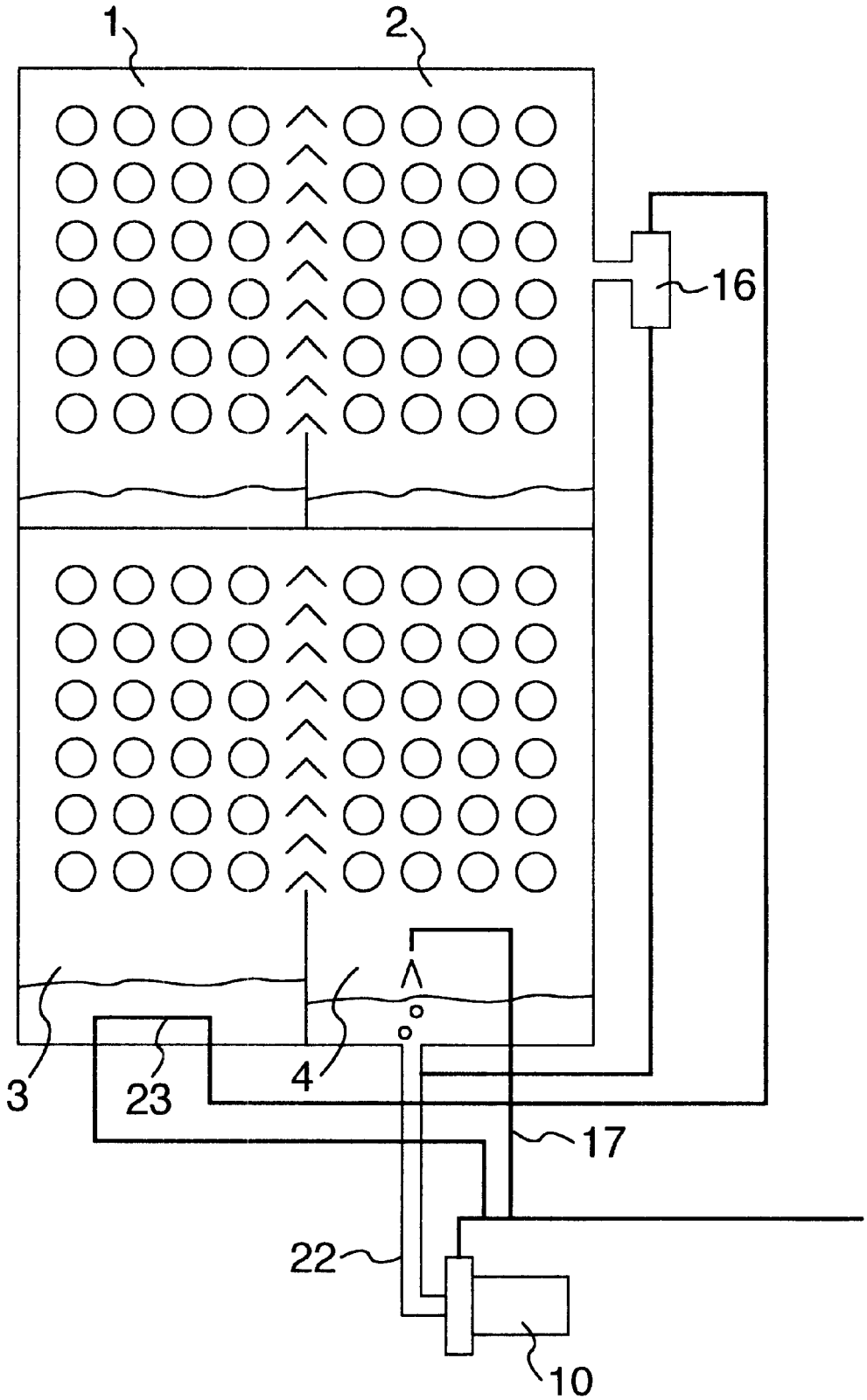
FIG. 2 through FIG. 9 are schematic diagrams of an absorber part of a two-stage absorption refrigerating apparatus of the present invention, which are variations of the embodiment illustrated in FIG. 1.

Also, for cooling the solution to be led to the low-pressure absorber 2, the cold of the high-pressure evaporator 3 may as well be used. Thus, as shown in FIG. 2, the weak solution pressurized by the solution-circulating pump 10 is led to the refrigerant tank section at the bottom of the high-pressure evaporator 3, cooled there, and thereafter led to the ejector 16 attached to the low-pressure absorber 2. This dispenses with any additional cooling means, and contributes to overall simplification of the absorption refrigerating apparatus. Incidentally, in the arrangement illustrated in FIG. 2, the solution containing the uncondensed gas sucked by the ejector 16 is returned to the suction pipe 22 provided underneath the high-pressure absorber 4. This arrangement serves to alleviate the load on bleeding means provided in the high-pressure absorber 4 and to make it possible to reduce the size of the bleeding means of the high-pressure absorber 4.

Here, the generating mechanism of the uncondensed gas will be described. As the high-temperature generator 9 is exposed to the high-temperature solution, corrosion will gradually progress from inside the high-temperature generator 9 unless some measure to prevent it is taken. In view of this need, an anticorrosive is mixed into the solution so that an oxidized film is formed on an internal surface of each element of the absorption refrigerating apparatus including the high-temperature generator 9. The oxidized film is formed by a reaction between water molecules in the solution and the anticorrosive, and more of the oxygen molecules in the water molecules are used for the formation of the oxidized film as the reaction proceeds, and hydrogen remains as the uncondensed gas.

The hydrogen gas generated in this way in the high-temperature generator 9 is carried, together with the refrigerant vapor, via the low-temperature generator 8 and the condenser 7 to the high-pressure evaporator 3. As the refrigerant vapor moves between the low-pressure evaporator 1 and the high-pressure evaporator 3, part of the uncondensed gas shifts from the high-pressure evaporator 3 to the low-pressure evaporator 1 along with the refrigerant vapor. Since the refrigerant vapor is flowing from the low-pressure evaporator 1 to the low-pressure absorber 2, the uncondensed gas in the low-pressure evaporator 1 also flows to the low-pressure absorber 2. Similarly, as the refrigerant vapor is flowing from the high-pressure evaporator 3 to the high-pressure absorber 4, the uncondensed gas in the high-pressure evaporator 3 flows to the high-pressure absorber 4.

In order to separate from the absorption solution the uncondensed gas extracted from the low-pressure absorber 2 and the high-pressure absorber 4, the uncondensed gas is led by the solution-circulating pump 10 to the high-temperature generator 9, and then via the low-temperature generator 8 to the condenser 7. The reason why the uncondensed gas is led to the condenser 7 is as follows. The pressures in the high-pressure absorber 4 and in the low-pressure absorber 2 are only about 1 kPa (7 mmHg) and they are far lower in comparison with the pressure of 80 kPa (550 mmHg) in the high-temperature generator 9 in which the uncondensed gas is generated. If it is attempted to separate the absorption solution and the uncondensed gas from each other without altering these pressures, a large-size gas-liquid separator will be required. Therefore in this embodiment, gas-liquid separation is accomplished at higher pressures than in the high-pressure absorber and the low-pressure absorber by putting together the uncondensed gas.

As the pressure in the condenser 7 is about 7 kPa (50 mmHg), the uncondensed gas is forced into the condenser 7, and is extracted with the ejector 18 provided in the condenser 7. The extracted condensed gas joins the driving solution led by the solution-circulating pump 10 via the pipe 18*b* to the ejector 18. Then it flows into the gas-liquid separator 19 from the pipe 18*c*. The uncondensed gas separated by the gas-liquid separator 19 is accommodated into the gas storage tank 20 via the pipe 20*b*.

The gas storage tank 20 is fitted with a pressure gauge, not shown, and, when the reading on this pressure gauge surpasses a predetermined level, the valve 33 is opened to discharge the gas in the gas storage tank with the ejector 21. Upon completion of the discharge, the valve 33 is closed. The gas storage tank 20 is provided in the highest position in the absorption refrigerating apparatus 100. The arrangement of the gas storage tank 20 in the highest position makes it possible, when there is no uncondensed gas in the absorption refrigerating apparatus, to fill the gas storage tank 20 with refrigerant vapor and to replace the refrigerant vapor with uncondensed gas when the latter is generated.

Incidentally, the reason why the rising part 32 is formed midway on the pipe 32*a* communicating with the suction pipe 22 connected to the bottom of the high-pressure absorber 4 to the gas-liquid separator 19 is as follows. As the top of the rising part 32 is communicated with the high-pressure absorber by a pipe, not shown, a pressure higher than the pressure within the high-pressure absorber 4 by the difference in head between the rising part 32 of the pipe 32*a* and the top of the gas-liquid separator 19 applies to the gas storage tank 20. As a result, the quantity of uncondensed gas that can be stored in the gas storage tank 20 increases. Furthermore, when the uncondensed gas in the gas storage tank 20 is discharged by the ejector 21 outside the absorption refrigerating apparatus, the pressure in the gas storage tank 20 is high, about 15 kPa (100 mmHg), a differential pressure necessary for the operation of the ejector 21 can be secured, and the operational range of the ejector 21 is expanded correspondingly. Furthermore, an appropriate pressure difference can be achieved between the suction pipe 22 and the condenser 7.

In this embodiment, in order to lead the refrigerant deposited in the refrigerant tank section of the low-pressure evaporator 1 to the refrigerant spraying device of the high-pressure evaporator 3, holes formed in the partition 1*c*, though not shown, is utilized. The low-pressure evaporator 1 and the high-pressure evaporator 3 arranged respectively above and below are liquid-sealed by the refrigerant dripping through the holes. The pressure difference between the low-pressure evaporator 1 and the high-pressure evaporator 3 is determined by the pressure of the refrigerant depositing in the refrigerant tank section of the low-pressure evaporator 1. Similarly, holes are formed in the partition 1*c* between the low-pressure absorber 2 and the high-pressure absorber 4, and the low-pressure absorber 2 and the high-pressure absorber 4 arranged respectively above and below are liquid-sealed by the solution dripping through the holes. The pressure difference between the low-pressure absorber 2 and the high-pressure absorber 4 is determined by the pressure of the solution depositing in the solution tank section of the low-pressure absorber 2.

As described above, according to this embodiment, each of the low-pressure absorber 2 and the high-pressure absorber 4 is provided with an ejector or a jet generator and a solution suction pipe as bleeding means. Therefore, the uncondensed gas can be efficiently extracted to enable the absorbers to perform satisfactorily. Furthermore, as the condenser is also provided with bleeding means, uncondensed gas resulted in different sections of the absorption refrigerating apparatus can be extracted even more efficiently.

Figure 3:
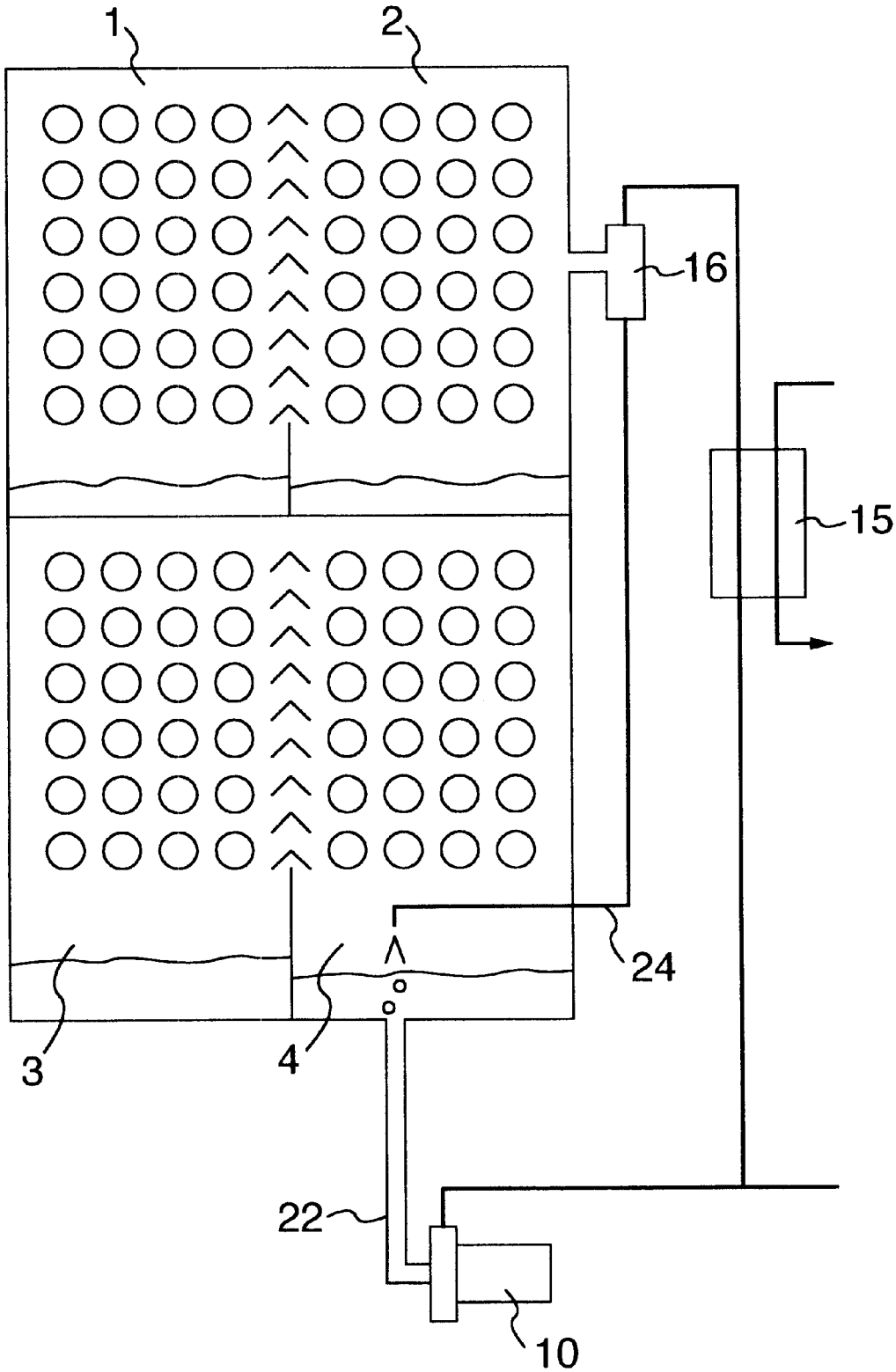

Further in this embodiment, solution containing uncondensed gas sucked by the ejector 16 appended to the low-pressure absorber 2 is simply led to the high-pressure absorber 4. However, as shown in FIG. 3, the vapor may as well be led by the pipe 24 to the vicinity of the solution tank section of the high-pressure absorber 4, and this pipe 24 can be used as bleeding means by causing it to blow out a jet of the solution. In this embodiment, as the discharge side of the ejector is utilized as the bleeding means of the high-pressure absorber, the bleeding means of the high-pressure absorber can be simplified.

Further in the above-described embodiment, the low-pressure absorber 2 uses the ejector 16, and the high-pressure absorber 4 uses jet blowing as their respective bleeding means. However, other embodiments may be used as shown in FIG. 4 through FIG. 9. In an embodiment shown in FIG. 4, an ejector is used as bleeding means for the low-pressure absorber 2 and a saucer 25 to receive the solution sprayed in the high-pressure absorber 4 is used as bleeding means for the high-pressure absorber 4. In an embodiment shown in FIG. 5, ejectors are used as bleeding means for both the high-pressure absorber 4 and the low-pressure absorber 2. In an embodiment shown in FIG. 6, solution jetting means are used as bleeding means for both the high-pressure absorber 4 and the low-pressure absorber 2. In an embodiment shown in FIG. 7, solution jetting means is used as bleeding means for the low-pressure absorber 2 and a saucer is used as bleeding means for the high-pressure absorber 4. In an embodiment shown in FIG. 8, solution jetting means are used as bleeding means for the low-pressure and high-pressure absorbers 2, 4 but the jetting means 38 for the low-pressure absorber 2 is provided on a side thereof.

Figure 4:
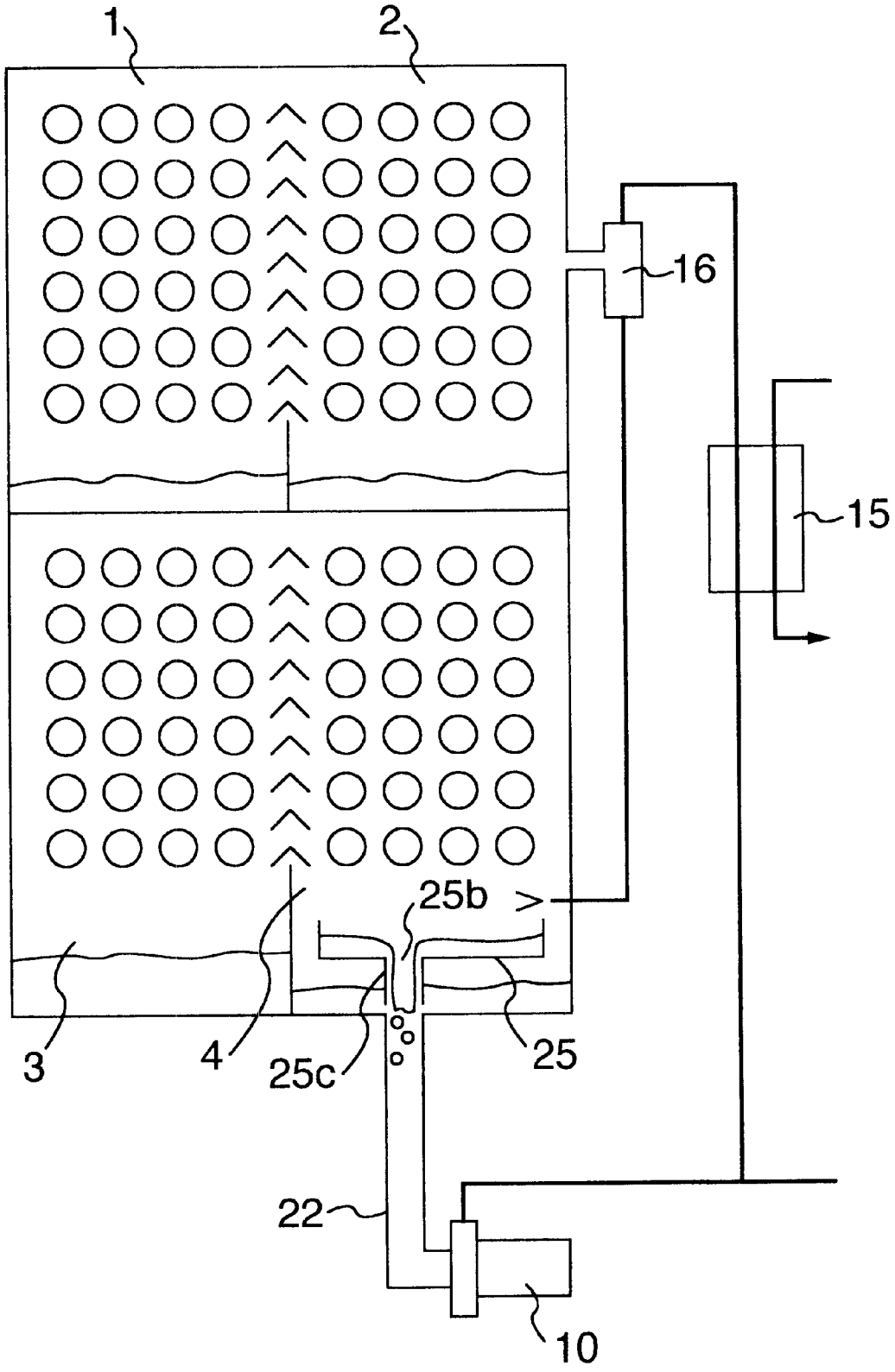

In the embodiment shown in FIG. 4, for instance, the solution sprayed from spraying means, not shown, within the high-pressure absorber 4 is collected onto the saucer 25, and is dropped through a port 25*b* provided at the center of the saucer 25 into a suction pipe 25*c* connected to the port 25*b*. When the solution drops, gas around it is dragged into the solution. Therefore, the configuration illustrated in FIG. 4 can also extract uncondensed gas effectively. Incidentally, it is preferable to arrange the suction pipe 25*c* right above the suction pipe 22.

Figure 5:
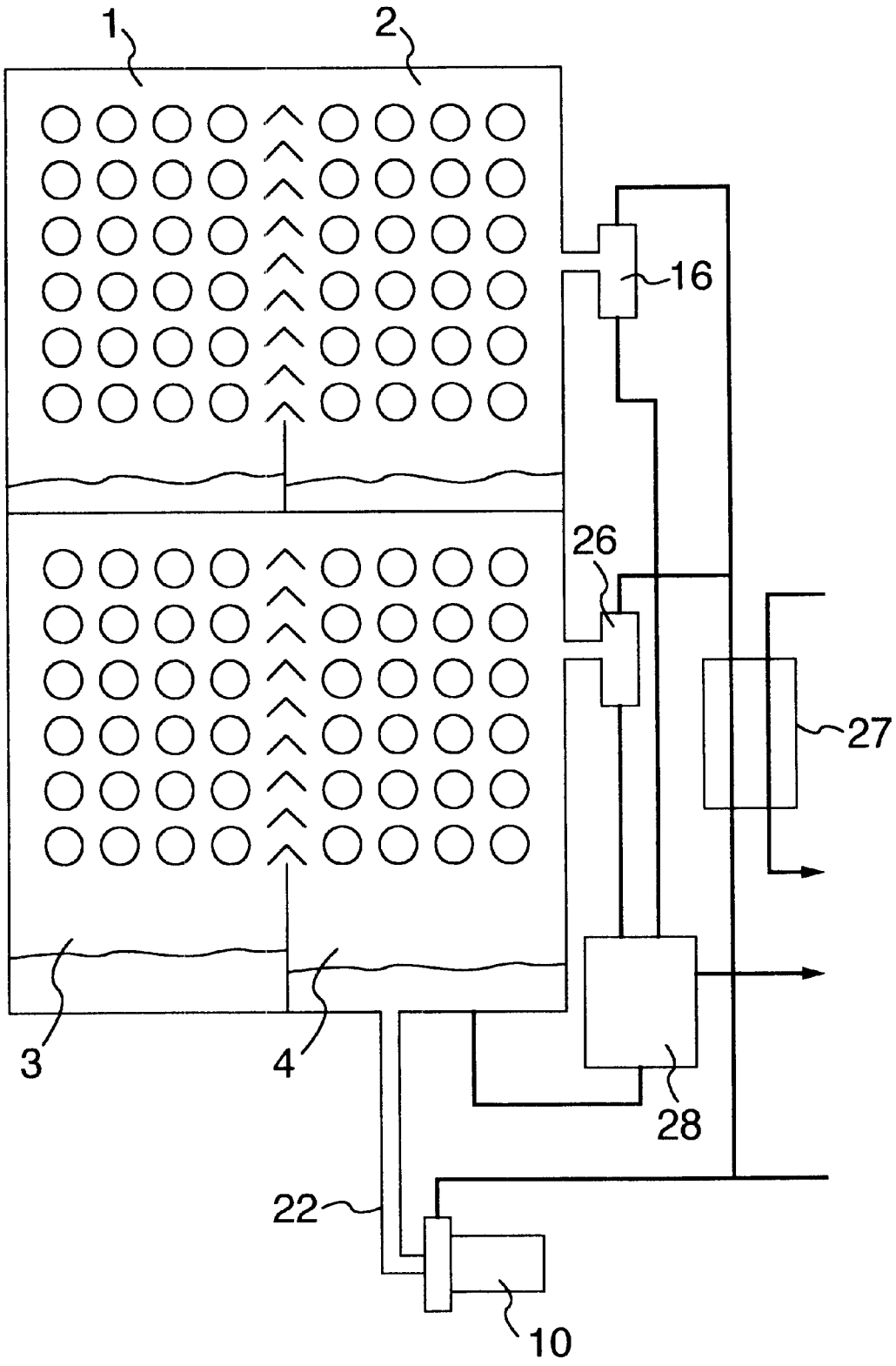

In the embodiment shown in FIG. 5, the low-pressure absorber 2 and the high-pressure absorber 4 are provided with ejectors 16 and 26, respectively. The refrigerant containing the uncondensed gas bled by the two ejectors 16 and 26 is cleared of the uncondensed gas content by the gas-liquid separator 28, and fed to the gas storage tank. On the other hand, the solution is returned to the high-pressure absorber 4 via a liquid-sealing section, not shown. Incidentally, the solution may as well be returned to the suction pipe 22 instead of feeding it to the high-pressure absorber 4.

Figure 6:
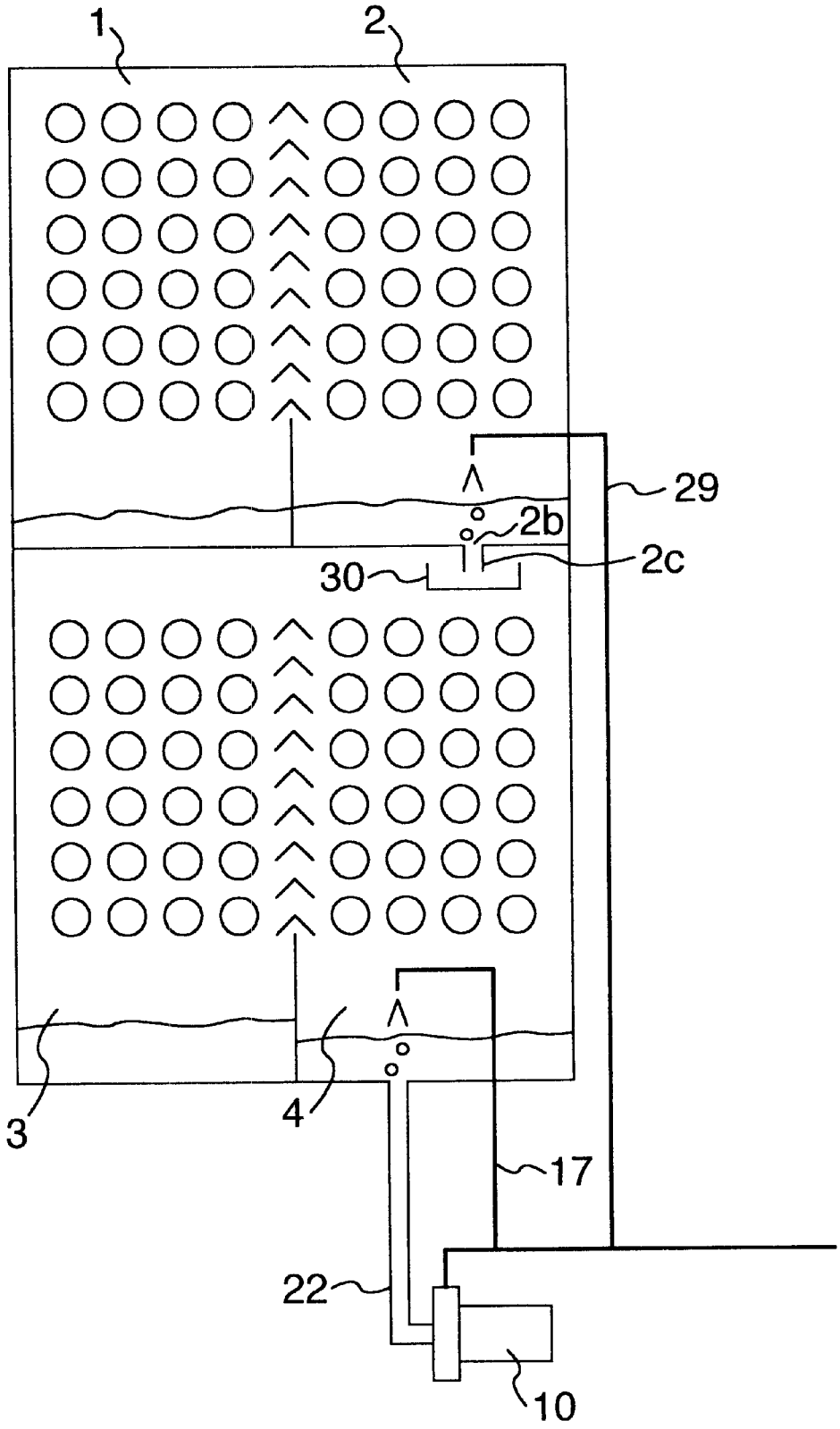

In the embodiment-shown in FIG. 6, a port 2*b* is formed in the partitioning plate 1*c* between the low-pressure absorber 2 and the high-pressure absorber 4, and a pipe 2*c* is connected to the underside of this port 2*b*. A saucer 30 is arranged underneath the pipe 2*c* on the high-temperature absorber 4 side. Above the port 2*b* is positioned a tip of a pipe for leading the solution pressurized by the solution-circulating pump 10 to the low-pressure absorber 2, and the solution is jetted into the solution tank section of the low-pressure absorber 2. This jet action is the same as that used for the above-described high-pressure absorber 4.

The saucer 30 should have a sufficiently greater width than the port 2*b* to prevent the uncondensed gas having moved from the low-pressure absorber 2 to the high-pressure absorber 4 from returning to the low-pressure absorber. The uncondensed gas, after being pushed by the solution flow into the high-pressure absorber 4, moves in radial direction on the broad saucer 30. As there is the partitioning plate 1*c* above the destination of the movement of the uncondensed gas, the uncondensed gas will remain in the high-pressure absorber 4 even if buoyant acts on the uncondensed gas.

Figure 7:
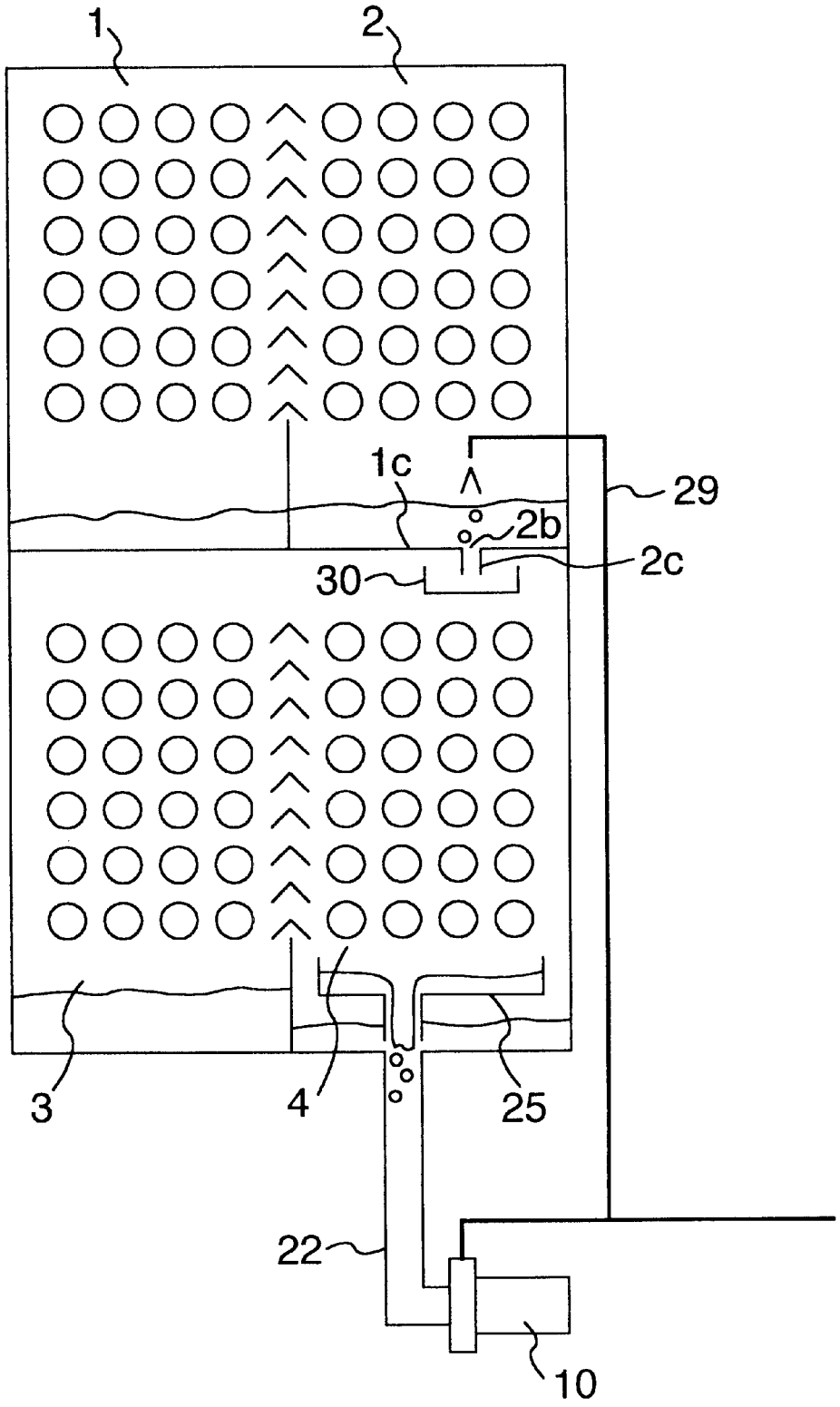

In the case of FIG. 7, the bleeding means of the high-pressure side absorber 4 is similar to that shown in FIG. 4 and the bleeding means of the low-pressure side absorber 2 is similar to that shown in FIG. 6. Therefore, the actions and effects of the individual bleeding means are respectively the same as those illustrated in the pertinent drawings.

Figure 8:
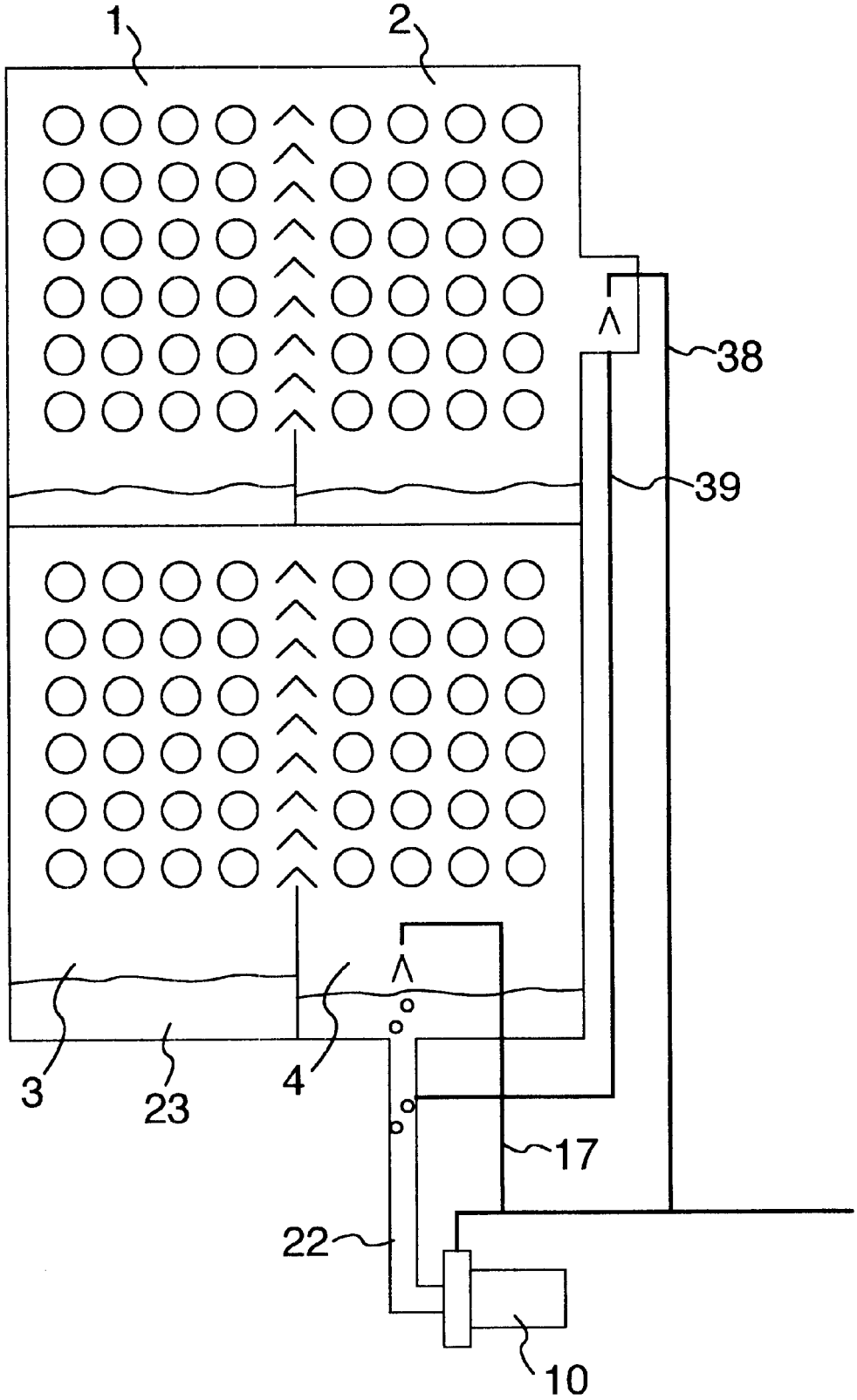

In the embodiment shown in FIG. 8, only the bleeding means of the low-pressure absorber 2 differs from that shown in FIG. 1, and the jetting means 38 is provided on a side part of the low-pressure absorber 2. The uncondensed gas extracted by the bleeding means is fed to the suction pipe 22 via a pipe 39. Since the configuration illustrated here uses a jet system, the solution discharged by the solution-circulating pump 10 need not be cooled, and it becomes therefore possible to dispense with cooling means for the solution to be jetted. However, if cooling means for the solution to be jetted is provided, the bleeding performance will be further improved.

Figure 9:
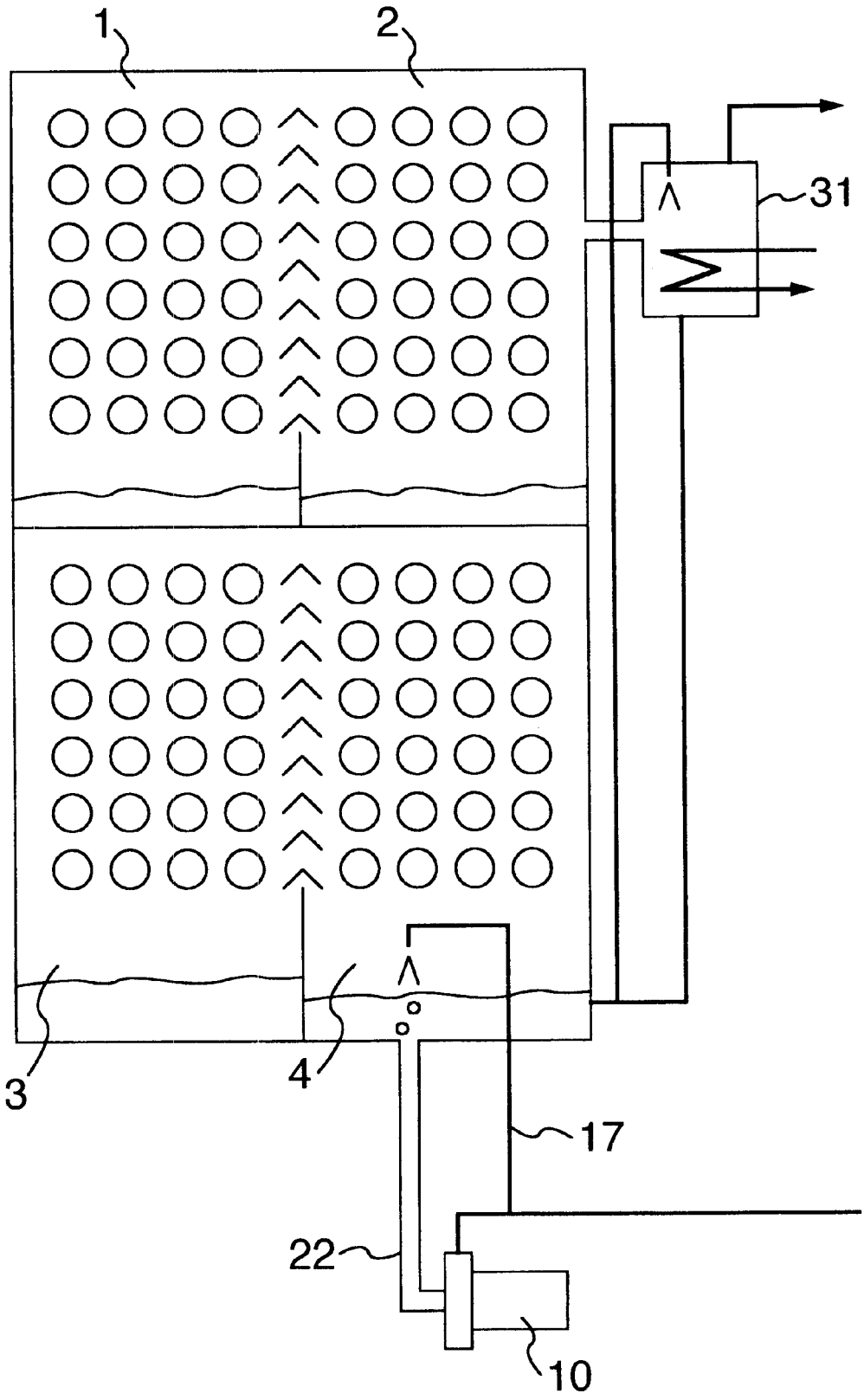

In an embodiment shown in FIG. 9, instead of the ejector shown in FIG. 1, which is used for the low-pressure absorber 2, a small absorber 31 for bleeding is provided. By keeping the pressure of the absorber 31 for bleeding lower than that of the low-pressure absorber 2, it becomes possible to lead the uncondensed gas from the low-pressure absorber 2 to the absorber 31 for bleeding. Since the absorber 31 for bleeding also serves as a gas-liquid separator, it can separate the uncondensed gas and lead it to the gas storage tank. In this configuration, the bottom face of the bleed absorber 31 is positioned higher than the liquid level of the solution depositing in the solution tank section of the high-pressure absorber 4 so that the solution may naturally flow from the bleed absorber 31 to the high-pressure absorber 4.

Further, although in the above-described embodiments the condenser is provided with an ejector to discharge uncondensed gas in the absorbers out of the absorption refrigerating apparatus, the bleeding means provided for the high-pressure absorber or the low-pressure absorber may also be used for the discharging purpose, or uncondensed gas may be discharged out of the absorption refrigerating apparatus with discharging means separately provided for these absorbers. In this case, uncondensed gas can be discharged out of the absorption refrigerating apparatus more reliably because it is discharged outside from a place where the pressure is lower and accordingly it is easier to collect uncondensed gas.

As described above, according to the present invention, where the absorption refrigerating apparatus has two stages of absorbers including a low-pressure absorber and a high-pressure absorber, each absorber is provided with bleeding means and therefore uncondensed gas resulted within the absorption refrigerating apparatus along with its operation can be efficiently extracted. This makes it possible to enhance the efficiency of the absorption refrigerating apparatus.

What is claimed is:

1. A two-stage absorption refrigerating apparatus, comprising: a high-temperature generator; a low-temperature generator; a condenser; a low-pressure absorber; a low-pressure evaporator; a high-pressure absorber; and a high-pressure evaporator, wherein said low-pressure absorber is provided with first bleeding means for bleeding uncondensed gas in the low-pressure absorber and said high-pressure absorber is provided with second bleeding means for bleeding uncondensed gas in the high-pressure absorber.

2. The two-stage absorption refrigerating apparatus according to claim 1, wherein said high-pressure absorber is arranged underneath said low-pressure absorber and said high-pressure evaporator is arranged underneath the low-pressure evaporator, and said first bleeding means and second bleeding means are supplied with the absorption solution from a single pump.

3. The two-stage absorption refrigerating apparatus according to claim 1, wherein the uncondensed gas extracted by said first bleeding means is led to said high-pressure absorber.

4. The two-stage absorption refrigerating apparatus according to claim 2, wherein confluent means for combining the uncondensed gas extracted by said first bleeding means with the uncondensed gas extracted by said second bleeding means is provided.

5. The two-stage absorption refrigerating apparatus according to claim 2, wherein said low-pressure absorber, said low-pressure evaporator, said high-pressure absorber and said high-pressure evaporator are configured into an integrated drum.

6. The two-stage absorption refrigerating apparatus according to claim 1, wherein said high-pressure absorber is arranged underneath said low-pressure absorber and said high-pressure evaporator is arranged underneath said low-pressure evaporator; and first pumping means for supplying the absorption solution to said first bleeding means is provided and second pumping means for supplying the absorption solution to said second bleeding means is provided; and the uncondensed gas extracted by said first bleeding means is led to said high-pressure absorber.

7. The two-stage absorption refrigerating apparatus according to claim 1, wherein said first bleeding means is provided near a side or a bottom of said low-pressure absorber and said second bleeding means is provided at a bottom of said high-pressure absorber.

8. The two-stage absorption refrigerating apparatus according to claim 2, wherein said first bleeding means is provided near a side or a bottom of said low-pressure absorber and said second bleeding means is provided at a bottom of said high-pressure absorber.

9. The two-stage absorption refrigerating apparatus according to claim 1, wherein at least one of said first bleeding means and said second bleeding means is an ejector or liquid jet type bleeding means.

10. The two-stage absorption refrigerating apparatus according to claim 2, wherein at least one of said first bleeding means and said second bleeding means is an ejector or liquid jet type bleeding means.

11. The two-stage absorption refrigerating apparatus according to claim 5, wherein a communicating pipe for leading the gas in said high-pressure absorber to said low-pressure absorber is provided on a side portion of the high-pressure absorber.

12. The two-stage absorption refrigerating apparatus according to claim 1, wherein piping means for leading the uncondensed gas extracted by said first bleeding means to a vicinity of said second bleeding means is provided.

13. The two-stage absorption refrigerating apparatus according to claim 2, wherein piping means for leading the uncondensed gas extracted by said first bleeding means to a vicinity of said second bleeding means is provided.

14. A two-stage absorption refrigerating apparatus comprising: a high-temperature generator; a low-temperature generator; a condenser; a low-pressure absorber; a low-pressure evaporator; a high-pressure absorber; and a high-pressure evaporator, and in which water is used as refrigerant and an aqueous solution of lithium bromide is used as absorption solution, wherein said low-pressure absorber is provided with first bleeding means for extracting uncondensed gas within the low-pressure absorber; said high-pressure absorber is provided with second bleeding means for extracting uncondensed gas within the high-pressure absorber; said condenser is provided with third bleeding means for extracting uncondensed gas within the condenser; a pump for supplying the solution to each of the bleeding means, a gas-liquid separator for separating the uncondensed gas extracted by each of the bleeding means from the solution, and a gas storage tank for storing the uncondensed gas separated from the solution are provided; and the uncondensed gas extracted by said first bleeding means and said second bleeding means is fed together with the solution by said pump to said high-temperature generator and low-temperature generator and thereafter is fed together with refrigerant vapor resulted at the high-temperature generator and the low-temperature generator to the condenser, and the uncondensed gas is extracted by the third bleeding means in the condenser, and the extracted uncondensed gas is fed together with the solution to the gas-liquid separator, and is separated from the solution by the gas-liquid separator, and is accommodated into said gas storage tank.

15. The two-stage absorption refrigerating apparatus according to claim 14, wherein said gas storage tank is provided with pressure gauging means, an ejector is connected to the tank through a valve, and the valve is opened when the pressure detected by said pressure gauging means surpasses a predetermined level, and the ejector is caused to discharge outside the uncondensed gas within the gas storage tank.

16. The two-stage absorption refrigerating apparatus according to claim 14, wherein said gas storage tank is arranged in the uppermost part of the two-stage absorption refrigerating apparatus.

17. The two-stage absorption refrigerating apparatus according to claim 15, wherein said gas storage tank is arranged in the uppermost part of the two-stage absorption refrigerating apparatus.

* * * * *